US006007744A

United States Patent [19]

Nacker

[11] Patent Number: 6,007,744

[45] Date of Patent: Dec. 28, 1999

[54] POLYMERIZABLE DYES AS TAGGANTS

[75] Inventor: Wayne Earl Nacker, Western Springs, Ill.

[73] Assignee: Morton International, Inc., Chicago, Ill.

[21] Appl. No.: 09/098,709

[22] Filed: Jun. 17, 1998

[51] Int. Cl.[6] ..... F21V 9/00; G01N 31/00; G01N 37/00

[52] U.S. Cl. ..... 252/582; 252/587; 252/589; 252/408.1; 252/965; 436/56

[58] Field of Search ..... 252/582, 587, 252/589, 408.1, 600, 965; 250/302; 436/56

[56] References Cited

U.S. PATENT DOCUMENTS

| | | | |
|---|---|---|---|
| 2,325,421 | 7/1943 | Omohundro | 252/965 |
| 3,861,886 | 1/1975 | Meloy | 436/56 |
| 4,009,008 | 2/1977 | Orelup | 252/408.1 |
| 4,441,943 | 4/1984 | Kydd | 252/965 |
| 4,764,474 | 8/1988 | Orelup | 436/56 |
| 5,128,419 | 7/1992 | Fong et al. | 252/582 |
| 5,166,074 | 11/1992 | Vessey et al. | 436/56 |
| 5,304,493 | 4/1994 | Nowak | 436/56 |
| 5,662,707 | 9/1997 | Jinkerson | 623/6 |
| 5,710,046 | 1/1998 | Rutledge et al. | 436/56 |
| 5,804,447 | 9/1998 | Albert et al. | 436/56 |
| 5,905,043 | 5/1999 | Heffron | 436/56 |
| 5,928,954 | 7/1999 | Rutledge et al. | 436/56 |

*Primary Examiner*—Philip Tucker
*Attorney, Agent, or Firm*—Wayne E. Nacker; Gerald K. White

[57] ABSTRACT

Liquids, such as petroleum fuels, are tagged with chemical compounds having a light-absorbing identifying chemical moiety and at least one polymerizable chemical moiety. The marker is identified in a specimen of the liquid by polymerizing the marker compound, generally along with additional co-polymerizable material.

4 Claims, No Drawings

POLYMERIZABLE DYES AS TAGGANTS

The present invention is directed to tagging materials, particularly liquids, with polymerizable markers and detecting the polymerizable markers in the tagged material.

BACKGROUND OF THE INVENTION

It is well known to add dyes and markers to liquid petroleum products as a means of identification for various purposes. For example, a fuel sold for agriculture purposes and taxed at a low rate may be tagged with a marker so that it can be identified if the fuel is illegally used in highway vehicles for which fuel is taxed at a higher rate. Markers may be used by a petroleum retailer to identify their brand at local filling stations.

While a large number of chemical compounds have been proposed as markers for petroleum fuels, in practice, the number of such dyes actually used is limited to a few accepted compounds. To be suitable as a petroleum fuel marker, a chemical compound must first of all be soluble and otherwise compatible with the petroleum fuel. Furthermore, there must be a way of identifying the presence of the marker in the tagged petroleum fuel, and for certain purposes, such as brand identification, this identification should be quantitative. Frequently, the method of identification involves extraction with an aqueous medium, e.g., either an acidic or alkaline medium, depending upon the marker, and often a chemical reaction which develops a color or a more intense color in the marker. It is desirable that a marker be silent, that is, while in the petroleum fuels at the tagging level, the marker should be colorless or substantially colorless, or else masked by natural colorants in the petroleum fuel or by other dyes added to the petroleum fuel. With the several rigid requirements for a good marker, the availability of commercially suitable markers remains limited.

While the use of markers has been most explored in respect to petroleum fuels, the use of such markers is expanding into other areas as well. For example, manufacturers of asphalt additives or concrete additives may wish to tag their product so that it can be determined if their additive in the recommended amounts was, indeed, added to a product in the correct amounts.

The present invention is directed to the use of polymerizable markers as a means of tagging and identifying materials, particularly liquid materials.

SUMMARY OF THE INVENTION

A marker chemical having an identifying moiety which has at least one strong absorbance peak within the range of UV-visible-IR light, and at least one, preferably at least two, polymerizable moieties, is added as a taggant in a liquid. To identify the marker chemical in the liquid, additional co-polymerizable material is added to the extent necessary to sustain a polymerization reaction, and polymerization is induced so as to form a polymerized residue which contains the marker chemical in concentrated form.

DETAILED DESCRIPTION OF CERTAIN PREFERRED EMBODIMENTS

U.S. Pat. No. 5,662,707 to Jinkerson, the teachings of which are incorporated herein by reference, teaches a variety of compounds in which dyes are linked, e.g., through SH, OH, or amine moieties, to one or more acrylic acid moieties, such as acrylic acid or methacrylic acid. The dye moieties provide color, e.g., a yellow color, and the acrylic moiety (ies) provide for the compounds to be incorporated by polymerization into materials suitable for ophthalmic lenses. Compounds, such as those taught in U.S. Pat. No. 5,662,707, having both a dye moiety and one, and preferably more than one, polymerizable moiety, are generally suitable as markers for use in the present invention. However, the invention is considered to be broader than the compounds taught in U.S. Pat. No. 5,662,707. The identifying moiety need not be a "dye" which exhibits color in the visible spectrum, but may be a moiety which has at least one strong absorption peak in either the UV or IR. For example, acrylic-functional UV absorbers, such as NORBLOCK® sold by Naramco Inc., New Brunswick N.J. are suitable markers for use in the present invention. Compounds having a strong absorption peak anywhere throughout the UV-visible-IR spectra, and having chemical functionality, e.g., OH, amine, SH, by which they can be chemically joined to a polymerizable moiety, such as an acrylic acid, can be converted to a suitable marker for use in the present invention.

Accordingly, the invention allows for a wide variety of markers which can be identified at a wide variety of absorbance frequencies. The identifying moiety will be selected according to the absorbance frequency at which it is to be detected, as well as its contribution to solubility in the liquid which is to be tagged with the marker compound. If the marker is to be identified by visual inspection, the identifying moiety should have a strong absorption peak in the visible spectrum, as is the case with the compounds described in U.S. Pat. No. 5,662,707. Even though the identifying moiety is visible, it may be "silent" or essentially "silent" in the tagged liquid because the tagging compounds are typically used at very low levels, e.g., between about 1 and about 100 parts per million by weight (ppm), preferably between about 5 and about 25 ppm. Also, any color imparted by the identifying moiety may be masked by naturally occurring or otherwise added colorants. For example, the yellow dyes described in U.S. Pat. No. 5,662,707 are easily masked by yellow colorants which may naturally occur in petroleum fuels. On the other hand, if the marker is to be totally "silent", the moiety may be a UV-absorber or an IR-absorber. Generally, reaction of an identifying compound with a polymerizable compound does not shift, to any significant extent, the absorption peaks of the identifying moiety in the marker compound, allowing markers to be tailored according to detection at desired absorption peaks.

Because of the wide range of absorption peaks which the identifying moiety may have, the invention affords identification systems using two or more marker compounds within the scope of the present invention, whereby the an endless variety of marker systems can be tailored by adjusting the relative amounts of two or more polymerizable marker compounds. Marker systems using two or more identifiable markers are described, for example, in European patent application EP 0 512 404 A1, the teachings of which are incorporated herein by reference.

An advantage of the markers of the present invention over those petroleum fuel markers which must be extracted in aqueous, e.g., alkaline aqueous or acidic aqueous, solutions, is that there need be no solubility balance between the petroleum-soluble form of the marker and the extracted form of the marker, which is typically a salt. It is only necessary that the marker compound of the present invention be soluble at the tagging level in the liquid it is to tag. Markers for petroleum fuels will be hydrophobic. Oh the other hand, hydrophilic markers may be used to tag additives to aqueous systems, such as concrete additives. The hydrophobic or hydrophilic characteristics of the marker will be determined both by the identifying moiety and by the polymerizable moiety(ies). For example, if a hydrophobic marker is desired, the polymerizable moiety selected might be methacrylic acid or even a more hydrophobic acrylic acid. If a hydrophilic marker is desired, hydroxyethylacrylate might be used as the polymerizable moiety.

Herein, the polymerizable moiety is described primarily in terms of α,β-ethylenically unsaturated compounds, particularly acrylic acids; however other polymerizable moieties are contemplated.

Detection of the marker is by polymerization of the marker so as to concentrate the marker in a residue polymer. If the identifying moiety absorbs in the visible range, a polymer incorporating the marker might exhibit a visible color. If the identifying moiety absorbs in the IR or UV range, it will be necessary to examine the IR or UV absorption of the polymer.

While the markers of the present invention are polymerizable by themselves, at the marking levels used, e.g. 1 to 100 ppm, it is generally difficult to sustain polymerization. Accordingly, it is contemplated that a specimen of potentially tagged liquid will be taken and additional polymerizable monomer added to an amount sufficient to sustain polymerization. For example, to a potentially tagged petroleum fuel, methacrylic acid may be added. Polymerization of an acrylic acid, and co-polymerization of the marker may be initiated in a number of ways, e.g., by heat, addition of an acid, such as HCl, or a free radical producer, such as hydrogen peroxide. Free radical polymerization may be initiated by a photosensitive initiator compound, such as phenyl acridine, upon exposure to UV light.

The polymerization reaction in which the marker is incorporated in a polymer acts to concentrate the marker and remove it from the marked liquid. Because the marker is removed from the tagged liquid, other colorants in the liquid, whether naturally occurring or artificially added, do not interfere with identification of the marker in the liquid.

The polymer will typically be insoluble in the tagged liquid, and precipitated polymer will tend to deposit on the surface of the polymerization vessel, e.g., a glass cuvette, whereby the polymer may be observed and even quantified, e.g. with a spectrophotometer.

In some cases, observation of the marker will be most accurate if the polymer becomes directly chemically bonded to a material through which absorption may be read in a spectrophotometer. For example, the polymerization may be effected in the presence of a film of material having co-polymerizable moieties, whereby, the polymer will incorporate the film-associated moieties and thereby be bonded to the film. The absorbance of such a film at selected wavelengths may be read, and the presence of marker quantifiably identified. For example, ethylene vinyl alcohol (EVOH) has hydroxyl functionality. A film of EVOH may be exposed to acrylic acid anhydride or methacrylic acid anhydride under conditions which bind acrylic acid or methacrylic acid moieties to the film. When an polymerization reaction is conducted in the presence of such a film, the marker and additional polymerizable monomer will form a film-bonded polymer which is readable spectrophotometrically and which provides a permanent record of the identification, for example, should such an identification be required for evidentiary purposes.

To the extent that the polymerization reaction is complete, and to the extent that any residual materials, including the additional polymerizable monomer and any initiator species, are not harmful to the product, e.g., the fuel, it may in many cases be possible to return the test specimen to the reservoir of liquid. When this can be done, it obviates disposal problems often associated with tested liquids. For example, when a petroleum product is tested by an extraction method, it is generally considered undesirable to return the test sample to the reservoir of petroleum product. Even in quantities as small as several milliliters, environmental regulations may govern the disposal of the tested sample of petroleum fuel, complicating matters for the field tester of the fuel. To the extent that the present invention allows tested fuel to be returned to the reservoir, the invention addresses an important disposal concern.

The invention will now be described in greater detail by way of specific examples.

EXAMPLE 1

Solvent yellow 58 is fully esterified with methacrylic anhydride as described in U.S. Pat. No. 5,662,707 to produce a marker having acrylate functionality of 2. This marker compound is added at 25 ppm to gasoline. 5 ml. of the tagged gasoline is withdrawn to a glass cuvette. 1 ml. methacrylic acid is added along with 0.05 ml phenyl acridine. The mixture is exposed to a photo flash lamp to initiate polymerization. After 1 minute, the liquid is poured from the cuvette, which is left coated with a yellow residue.

EXAMPLE 2

A film of EVOH is exposed to an excess of methacrylic anhydride for one hour. Gasoline tagged in Example 1 is transferred to a test tube which contains a square of the treated EVOH film. In the manner of Example 1, methacrylic acid and phenyl acridine are added and polymerization is induced by a photo flash lamp. The square of film is withdrawn from the test tube and exhibits a yellow color.

What is claimed is:

1. A method of tagging a liquid product and identifying the tagged product comprising, providing a marker compound having an identifying chemical moiety having at least one strong absorption peak within the UV-visible-IR spectra and at least one polymerizable chemical moiety, tagging a liquid with said marker compound, in a specimen of said liquid, polymerizing said marker compound, and identifying said marker compound in the polymerized product according to the absorption peak of said identifying chemical moiety.

2. A method according to claim 1 wherein additional polymerizable material is added to said specimen of said liquid sufficient to sustain polymerization.

3. A method according to claim 2 wherein a polymerization catalyst is added to said specimen of said liquid to promote polymerization.

4. A method according to claim 1 wherein said polymerization is conducted in the presence of a sheet of material to which is pre-bonded a co-polymerizable monomer.

* * * * *